US006945759B2

(12) United States Patent
Henderson

(10) Patent No.: US 6,945,759 B2
(45) Date of Patent: Sep. 20, 2005

(54) ENGINE DRIVEN DRY AIR PUMP WITH A FLANGE MOUNTED OIL DRAIN

(75) Inventor: Timothy H. Henderson, 2041 Cullen Rd., Gibsonville, NC (US) 27249

(73) Assignee: Timothy H. Henderson, Gibsonville, NC (US)

( * ) Notice: Subject to any disclaimer, the term of this patent is extended or adjusted under 35 U.S.C. 154(b) by 305 days.

(21) Appl. No.: 10/439,945

(22) Filed: May 16, 2003

(65) Prior Publication Data

US 2004/0197206 A1 Oct. 7, 2004

Related U.S. Application Data

(60) Provisional application No. 60/459,401, filed on Apr. 1, 2003.

(51) Int. Cl.[7] ..... F04B 37/00

(52) U.S. Cl. ..... 417/410.3; 417/364; 184/6.16; 418/104; 277/608; 277/614; 277/602

(58) Field of Search ..... 417/410.3, 366, 417/423.1, 364; 418/104, 259, 83, 92; 184/6.16; 277/602, 608, 614

(56) References Cited

U.S. PATENT DOCUMENTS

| | | | | |
|---|---|---|---|---|
| 448,765 A | * | 3/1891 | Kaiser | 285/119 |
| 706,158 A | | 8/1902 | Charles | |
| 959,960 A | * | 5/1910 | Oleson | 277/608 |
| 1,441,344 A | * | 1/1923 | Hatcher | 417/410.3 |
| 1,855,494 A | * | 4/1932 | Sorensen | 277/614 |
| 1,911,128 A | * | 5/1933 | Apple et al. | 417/371 |
| 2,552,750 A | * | 5/1951 | Thornhill | 277/614 |
| 2,781,000 A | | 2/1957 | Thomas et al. | |
| 2,938,468 A | * | 5/1960 | Kececioglu et al. | 417/354 |
| 3,036,527 A | | 5/1962 | Peterson | |
| 3,102,493 A | | 9/1963 | Davin | |
| 3,191,852 A | | 6/1965 | Kaatz | |
| 3,301,194 A | | 1/1967 | Brunson | |
| 3,311,391 A | * | 3/1967 | Harrell | 285/58 |
| 3,339,948 A | * | 9/1967 | Weitzel | 285/331 |
| 3,367,682 A | * | 2/1968 | Meriano | 285/106 |
| 3,398,884 A | | 8/1968 | Kaatz et al. | |

(Continued)

FOREIGN PATENT DOCUMENTS

| | | |
|---|---|---|
| AT | 53868 | 2/1912 |
| AU | 82659/91 | 10/1991 |
| DE | 3321380 A1 | 12/1984 |
| FR | 2596107 | 9/1987 |

OTHER PUBLICATIONS

Fruitland Tool and Mfg., Fruitland Vacuum Pump Operation and Maintenance Manual, Stoney Creek, ON, Canada, (1 con't) including drawings dated 1978 to 2002. Accessed at www.fruitland–mfg.co on Sep. 9, 2003. See p. 5.

(Continued)

*Primary Examiner*—Charles G. Freay
*Assistant Examiner*—Emmanuel Sayoc
(74) *Attorney, Agent, or Firm*—Adams Evans P.A.

(57) ABSTRACT

A mounting end of an engine-driven accessory includes a longitudinally-extending neck having imperforate lateral surfaces defining a central bore. A flange having a mounting face is disposed at the end of neck. A plurality of generally radially extending drain passages are formed through the flange, which communicate with the central bore to form a fluid flow path between the bore and the exterior of the flange. A seal is provided for blocking selected ones of the drain passages while leaving the remainder of the drain passages open. The accessory may include a cover having an integral sealing rim which cooperates with a notch in a mating component to compress a portion of a resilient seal while simultaneously allowing for expansion of the remainder of the seal.

24 Claims, 11 Drawing Sheets

U.S. PATENT DOCUMENTS

| | | | | | |
|---|---|---|---|---|---|
| 3,463,384 | A | | 8/1969 | Kilbane | |
| 3,469,500 | A | | 9/1969 | Lutz et al. | |
| 3,552,895 | A | | 1/1971 | Bayley | |
| 3,565,558 | A | * | 2/1971 | Tobacman | 418/150 |
| 3,630,553 | A | * | 12/1971 | Foulger | 285/340 |
| 3,838,942 | A | * | 10/1974 | Pokorny | 417/269 |
| 3,989,285 | A | * | 11/1976 | Yancey | 285/336 |
| 4,095,921 | A | * | 6/1978 | Hiraga et al. | 417/269 |
| 4,130,287 | A | * | 12/1978 | Ritzie | 277/361 |
| 4,802,698 | A | * | 2/1989 | Fujisawa et al. | 285/363 |
| 4,804,317 | A | | 2/1989 | Smart et al. | |
| 4,820,140 | A | | 4/1989 | Bishop | |
| 4,923,377 | A | * | 5/1990 | Cavalleri | 418/98 |
| 5,318,409 | A | | 6/1994 | London et al. | |
| 5,720,598 | A | | 2/1998 | de Chizzelle | |
| 5,855,397 | A | * | 1/1999 | Black et al. | 285/93 |
| 6,123,061 | A | * | 9/2000 | Baker et al. | 123/573 |
| 6,318,147 | B1 | | 11/2001 | Steinruck et al. | |
| 6,368,066 | B2 | | 4/2002 | Aiyama et al. | |
| 6,450,789 | B1 | | 9/2002 | Henderson | |
| 6,695,599 | B2 | * | 2/2004 | Uchida et al. | 418/55.4 |

OTHER PUBLICATIONS

Mannesmann–Demag, Instruction Manual and Spare Parts List for Air–Cooled Rotary Compressors and Vaccum Pumps, Nr. BE 10/1982/3US, 1982, Schopfheim, Germany, See p. 14.

Blackmer, Blackmer Rotary Vane Compressors Installation, Operation and Maintenance Instructions, Model: E56, E106, E156, Oct. 1999, Grand Rapids, MI, USA. See pp. 7–8.

* cited by examiner

ENGINE DRIVEN DRY AIR PUMP WITH A FLANGE MOUNTED OIL DRAIN

CROSS-REFERENCE TO RELATED APPLICATIONS

This application claims the benefit of U.S. Provisional Application No. 60/459,401, filed Apr. 1, 2003.

BACKGROUND OF THE INVENTION

This invention relates generally to air pumps and more particularly to a carbon vane dry air pump. Commonly available dry vacuum pumps comprise mechanical carbon rotors and vanes operating in a hardened metal ellipsoidal cavity. These pumps provide a power source for, among other things, gyroscopically controlled, pneumatically operated flight instruments.

A dry air type rotary vane pump usually has a rotor with radial slots, vanes that reciprocate within these slots, and a chamber contour within which the vane tips trace their path as they rotate and reciprocate within their rotor slots. The reciprocating vanes thus extend and retract synchronously with the relative rotation of the rotor and the shape of the chamber surface in such a way as to create cascading cells of compression and/or expansion, thereby providing the essential components of a pumping machine.

Because dry air pumps do not use a liquid lubricant, forms of dry lubrication have been developed. For example, vanes for rotary pumps have been manufactured from carbon or carbon graphite. These parts rub against other stationary or moving parts of the pump during operation. Graphite dust from these parts is deposited on the opposing parts by the rubbing action and forms a low friction film between the parts, thereby providing lubrication. The deposited graphite film is itself worn away by continued operation of the pump, and is eventually exhausted out of the pump. The film is replaced by further wear of the carbon graphite parts. Thus, lubrication is provided on a continuous basis that continuously wears away the carbon graphite parts.

One of the primary causes of carbon vane dry pump failure is contamination with engine lubricating oil. If engine lubricating oil passes through the drive system into the interior of the pump in moderate quantities, it will mix with the graphite dust to form a viscous sludge which has poor lubricating properties. This causes overheating and eventual seizing and failure. Because the seals used at the air-oil interface of commercially available pumps and drives are not 100% effective, drain openings are usually provided for draining any leaking oil before it reaches the carbon vanes. However, the drain openings used in the prior art require that a significant portion of the pump housing fill with oil before it drains. This causes the shaft to pick up and sling the oil through drain openings in several directions from the pump. This makes it difficult to determine the source of an oil leak. Furthermore, this drain arrangement collects a significant quantity of oil at the air-oil interface which increases the probability that the oil will migrate into the vane chamber. Finally, because the drains are usually arrayed all the way around the pump to create a "universal" fit air pump, the drive area is open and can be easily contaminated, for example during an engine solvent wash.

Accordingly, it is an object of the invention to provide a vane pump which resists leakage of oil into the working parts of the pump.

It is another object of the invention to provide a vane pump which provides an easily interpreted indicator of the source of a lubricating oil leak.

It is another object of the invention to provide a universal-fit air pump having an air seal which is easily installed in a correct position.

It is another object of the invention to provide a vane pump which provides improved sealing between its component parts It is another object of the invention to provide a vane pump having the shortest possible leakage path.

BRIEF SUMMARY OF THE INVENTION

The above-mentioned need is met by the present invention, which provides a dry air pump for being attached to an oil-lubricated engine, having: a housing containing a plurality of movable engine-driven vanes for pumping a fluid; and a longitudinally-extending neck with imperforate lateral surfaces defining a central bore. A first end of the neck is attached to a working portion of the accessory, and a flange disposed at an opposite end of the neck from the first end, said flange having a mounting face. A plurality of generally radially extending drain passages are formed through the flange. The drain passages communicate with the central bore to form a fluid flow path between the bore and the exterior of the flange.

According to another embodiment of the present invention, the dry air pump includes means for blocking selected ones of the drain passages.

According to another embodiment of the present invention, the drain passages comprise a plurality of radial channels passing through the peripheral edge of the flange.

According to another embodiment of the present invention, the drain passages comprise a plurality of radially-extending grooves formed in the mounting face.

According to another embodiment of the present invention, the radially-extending grooves are connected by a circumferentially-extending groove formed in the mounting face, the circular groove intersecting each of the radially-extending grooves.

According to another embodiment of the present invention, the circumferentially-extending groove further includes at least one enlarged circumferentially-extending pocket disposed at the intersection of the circular groove and one of the radially-extending grooves.

According to another embodiment of the present invention, the dry air pump further includes a circular rim extending axially away from the mounting face, and the radially-extending grooves pass through the rim.

According to another embodiment of the present invention, the dry air pump further includes a resilient seal for being received in the grooves. The seal comprises a plurality of radially-extending legs connected by a an arcuate center portion. The seal blocks selected ones of the radially-extending grooves.

According to another embodiment of the present invention, the neck and the flange are attached to a body portion, and the body portion, the neck and the flange collectively form a drive cover.

According to another embodiment of the present invention, the body portion has an chamfered edge.

According to another embodiment of the present invention, the dry air pump comprises an assembly of the drive cover and a rear cover disposed on opposite ends of an elongated stator.

According to another embodiment of the present invention, the drive cover, the stator, and the rear cover are clamped together by at least one fastener which passes through one of the rear cover and the drive cover, passes through the stator, and is secured in the other of the drive cover and the rear cover.

According to another embodiment of the present invention, one of the stator and the body of the drive cover has a notch formed in the outer periphery of an end thereof for receiving a circumferentially-extending resilient seal, the notch further defining an axially facing raised sealing surface. The other of the stator and the body of the drive cover includes a flat sealing surface for being disposed in contact with the raised sealing surface, and a rim disposed around the periphery of, and extending axially away from, the flat sealing surface, wherein an axially-facing surface of the rim is beveled to form a narrow contact surface. When the stator and the drive cover are assembled, the rim surrounds the raised sealing surface, and a portion of the resilient seal is compressed in the axial direction between the narrow contact surface and an axially-facing portion of the notch, while another portion of the seal protrudes into an expansion volume defined between the notch and the beveled surface.

According to another embodiment of the present invention, a drive cover for an engine-driven accessory is provided, having a longitudinally-extending neck with imperforate lateral surfaces defining a central bore. A body portion mates with a working portion of the accessory disposed at a first end of the neck, and a flange is disposed at an opposite end of the neck from the body portion. The flange has a mounting face, wherein a plurality of generally radially extending drain passages are formed through the flange. The drain passages communicate with the central bore to form a fluid flow path between the bore and the exterior of the drive cover.

According to another embodiment of the present invention, the body portion of the drive cover includes a flat sealing surface, and a rim disposed around the periphery of, and extending axially away from, the flat sealing surface. An axially-facing surface of the rim is beveled to form a narrow contact surface.

According to another embodiment of the present invention, a dry air pump is provided, having a stator for housing the operating components of the accessory; and a cover for being attached to an end of the stator. One of the stator and the body portion of the drive cover has a notch formed in the outer periphery of an end thereof for receiving a circumferentially-extending resilient seal, the notch further defining an axially facing raised sealing surface. The other of the stator and the cover includes a flat sealing surface for being disposed in contact with the raised sealing surface, and a rim disposed around the periphery of, and extending axially away from, the flat sealing surface. An axially-facing surface of the rim is beveled to form a narrow contact surface. When the stator and the cover are assembled, the rim surrounds the raised sealing surface, and a portion of the resilient seal is compressed in the axial direction between the narrow contact surface and an axially-facing portion of the notch, while another portion of the seal protrudes into an expansion volume defined between the notch and the beveled surface.

According to another embodiment of the present invention, the cover is a drive cover including a longitudinally-extending neck having imperforate lateral surfaces defining a central bore. A flange is disposed at an end of the neck. The flange has a mounting face, wherein a plurality of generally radially extending drain passages are formed through the flange. The drain passages communicate with the central bore to form a fluid flow path between the bore and the exterior of the drive cover.

According to another embodiment of the present invention, a method of sealing an engine-driven accessory comprises the steps of providing an accessory having a longitudinally-extending neck having imperforate lateral surfaces defining a central bore, and a flange disposed at an end of the neck. The flange has a mounting face, wherein a plurality of generally radially extending drain passages are formed through the flange. The drain passages communicate with the central bore to form a fluid flow path between the bore and the exterior of the drive cover. A resilient seal is provided for being received in the grooves. The seal comprises a plurality of radially-extending legs connected by an arcuate center portion. The seal is placed in the drain grooves such that a selected one of the drain grooves is open and the remainder of the drain grooves are blocked by the seal.

BRIEF DESCRIPTION OF THE DRAWINGS

The subject matter that is regarded as the invention may be best understood by reference to the following description taken in conjunction with the accompanying drawing figures in which.

DETAILED DESCRIPTION OF THE INVENTION

Figure 1:
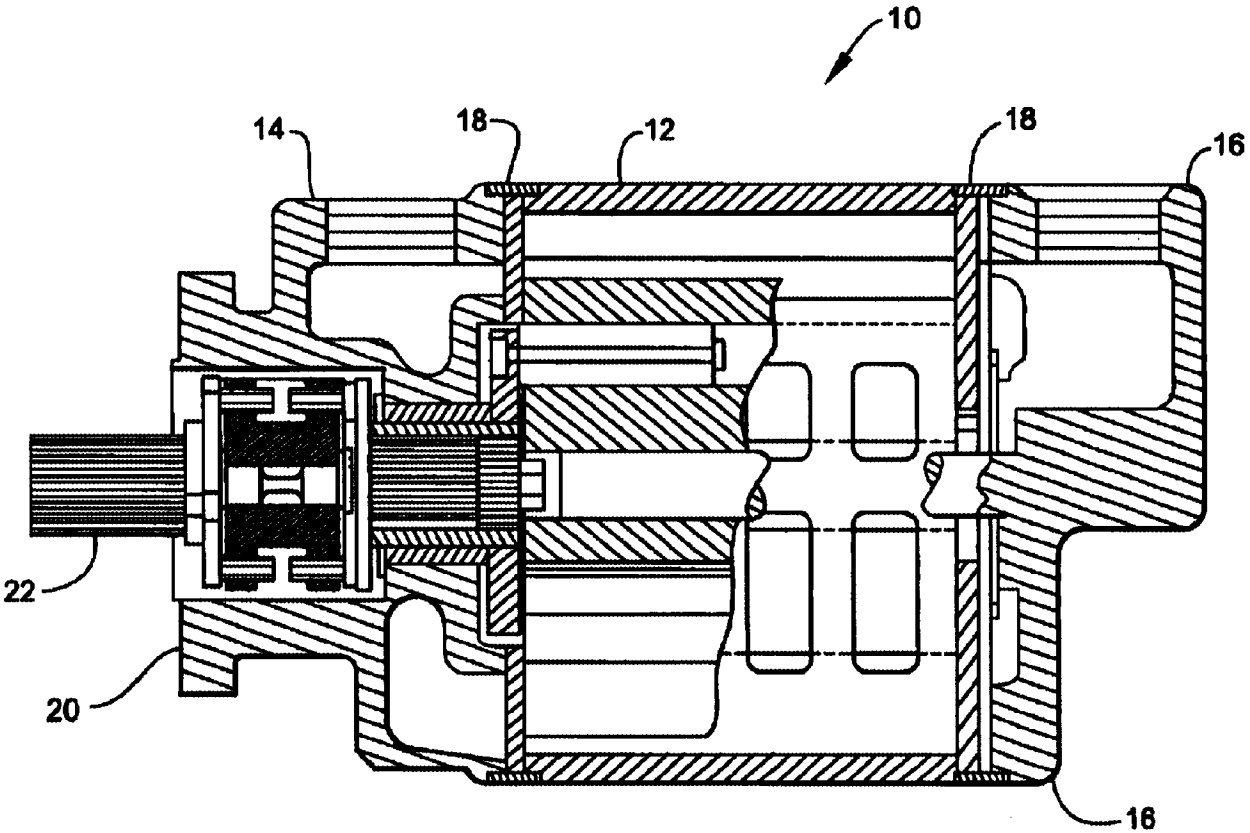
Fig. 1 Prior Art
FIG. 1 is a cross-sectional view through the centerline of a prior art rotary pump.
Figure 2:
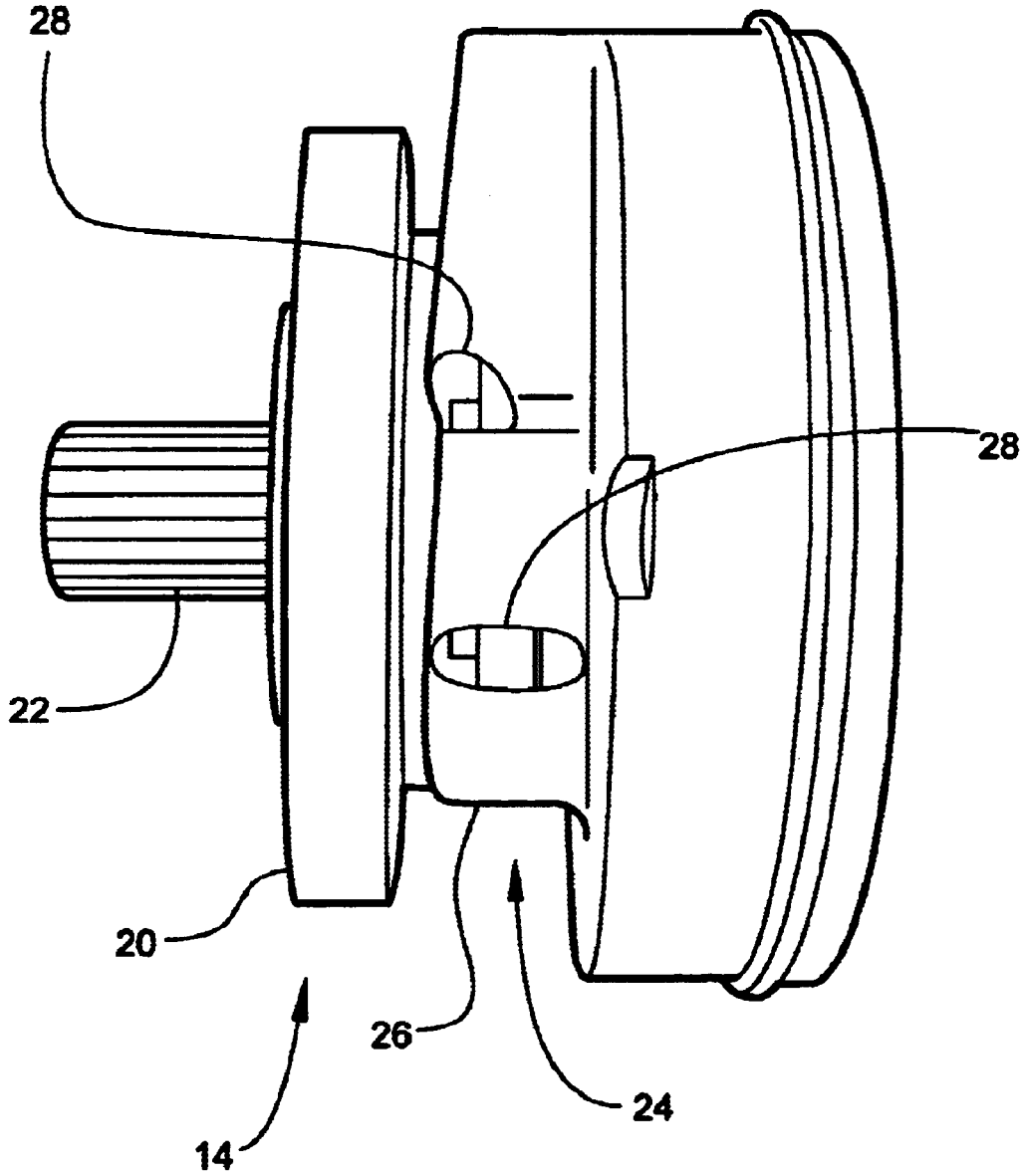
Fig. 2 Prior Art
FIG. 2 is a side view of the drive cover of the prior art pump of FIG. 1.

Referring to the drawings wherein identical reference numerals denote the same elements throughout the various views, FIG. 1 shows a side view of a prior art dry air pump 10. The pump 10 includes a stator 12 which contains the rotor and carbon vanes, a drive cover 14 and a rear cover 16. The covers 14 and 16 are bolted to the stator 12. The covers 14 and 16 and the stator 12 collectively define the housing of the pump 10. A pair of circumferentially extending bands 18 encircle joints between the stator 12 and the covers 14 and 16, providing surfaces which a seal (not shown) may bear against. The drive cover 14 includes a flange 20 which is adapted to be attached to an accessory mounting pad on an engine block (not shown). A splined pump shaft 22 extends from the flange 22 and engages an accessory shaft in the engine which drives the pump 10. As shown in FIG. 2, the drive cover 14 includes a neck 24 connecting the flange 22 to the remainder of the drive cover 14. This neck 24 comprises a plurality of axially extending struts 26 with spaces 28 in between that serve as drains.

Figure 3:
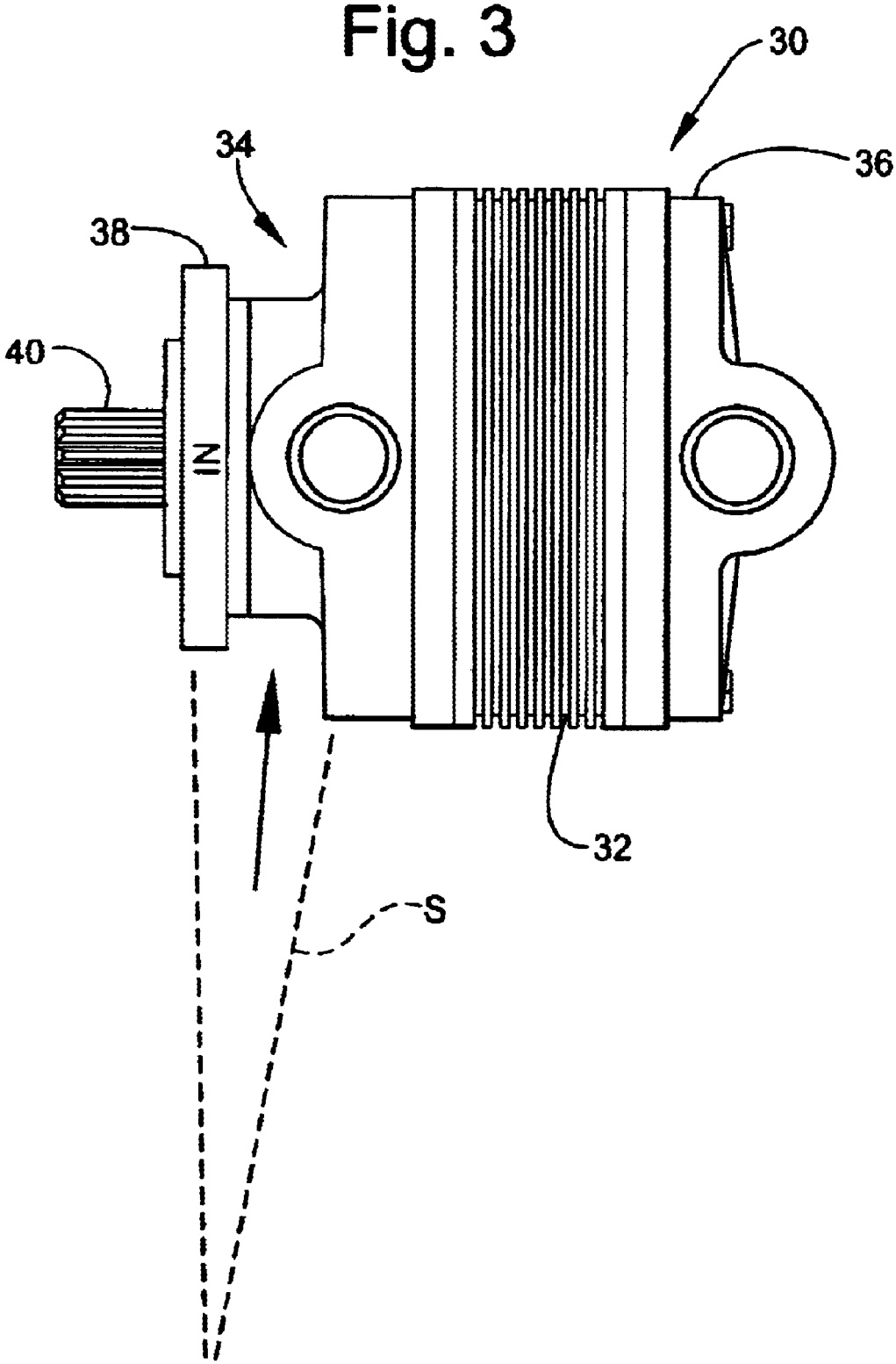
FIG. 3 is a schematic top view of a pump constructed in accordance with the present invention.

FIG. 3 shows a top view of a dry air pump 30 constructed in accordance with the present invention. It is noted that, although the present invention is illustrated in the context of carbon vane dry air pumps for aircraft applications, the invention is equally applicable to any other type of shaft-driven engine accessory or mechanism in which is it desired to provide a seal between a liquid and air interface. The basic components of the pump 30 are a stator 32 which contains the carbon vanes (not shown), a drive cover 34, and a rear cover 36. The covers 34, 36 and the stator 32 are clamped together with fasteners such as through bolts in a manner described in detail below. The drive cover 34 includes a flange 38 which is attached to an accessory mounting pad on an engine block (not shown). A pump shaft 40 extends from the flange 38 and engages an accessory shaft in the engine which drives the pump 30.

Figure 5:
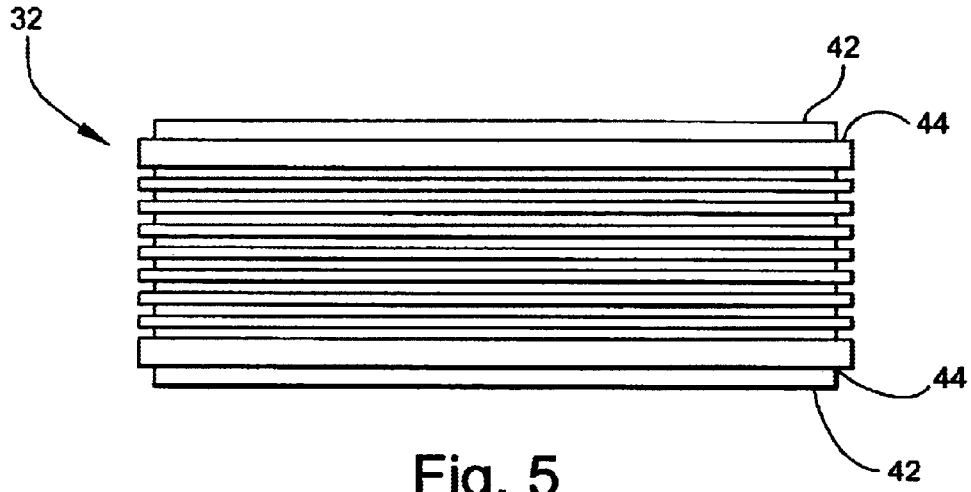
FIG. 5 is a view taken along lines 5—5 of FIG. 4.
Figure 4:
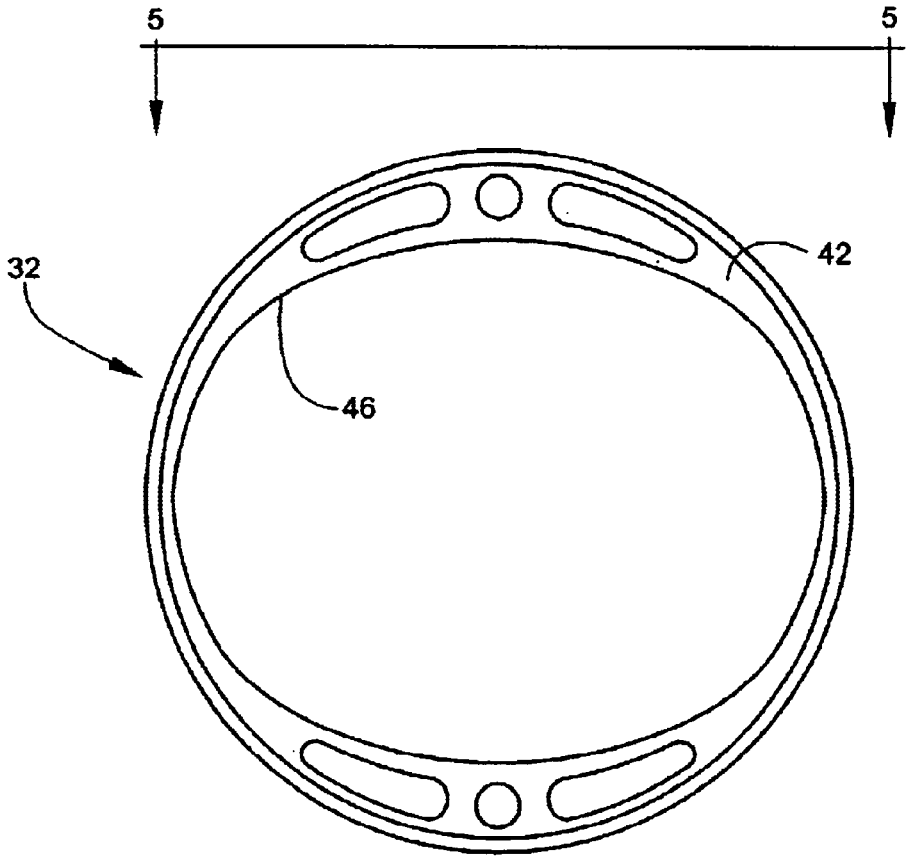
FIG. 4 is a end view of a stator of the pump of FIG. 3.
Figure 7:
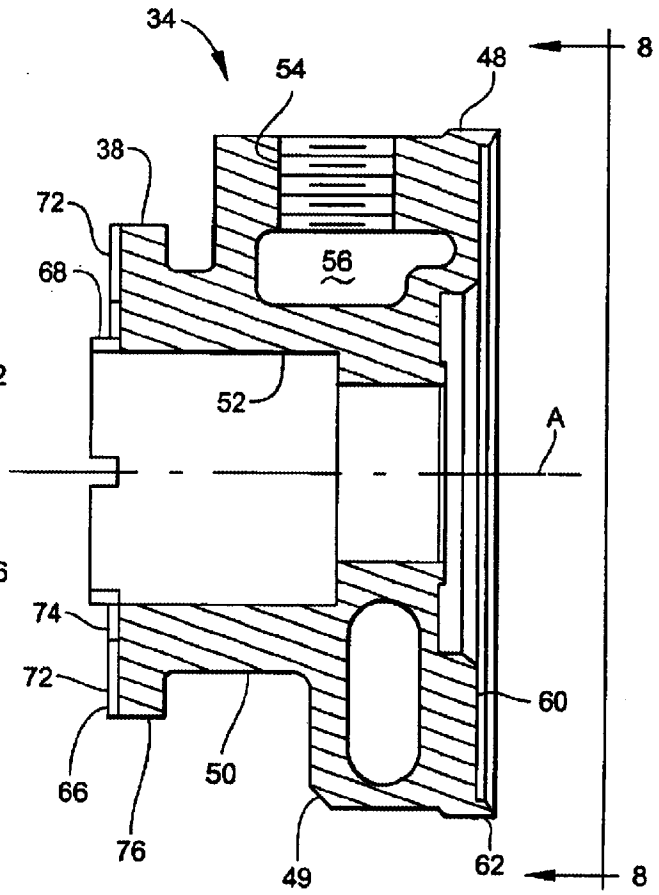
FIG. 7 is a view taken along lines 7—7 of FIG. 6.
Figure 6:
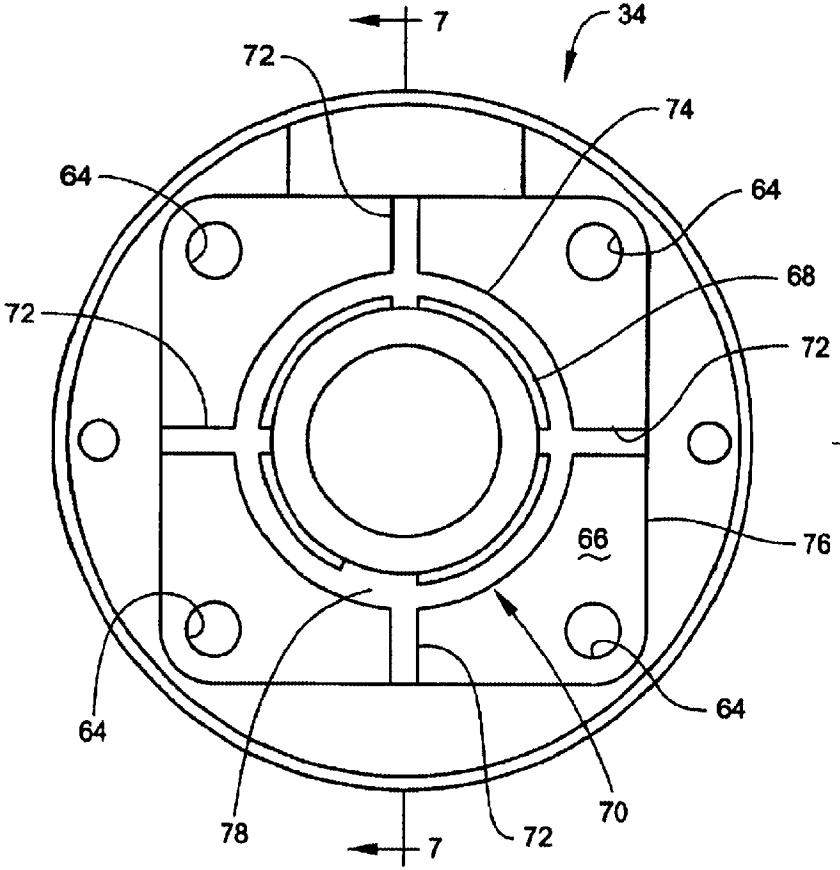
FIG. 6 is a view of the mounting end of the drive cover of FIG. 3.

FIGS. 4 and 5 illustrate the stator 32. Each end of the stator 32 includes a raised sealing surface 42 which mates against an adjacent sealing surface of the drive cover 34 and the rear cover 36, as described in more detail below. The periphery of the sealing surface 42 is defined by a notch 44 which receives a resilient seal (not shown). The interior of the stator 32 includes a generally oval working surface 46 which the carbon vanes (not shown) seal against during operation.

Figure 8:
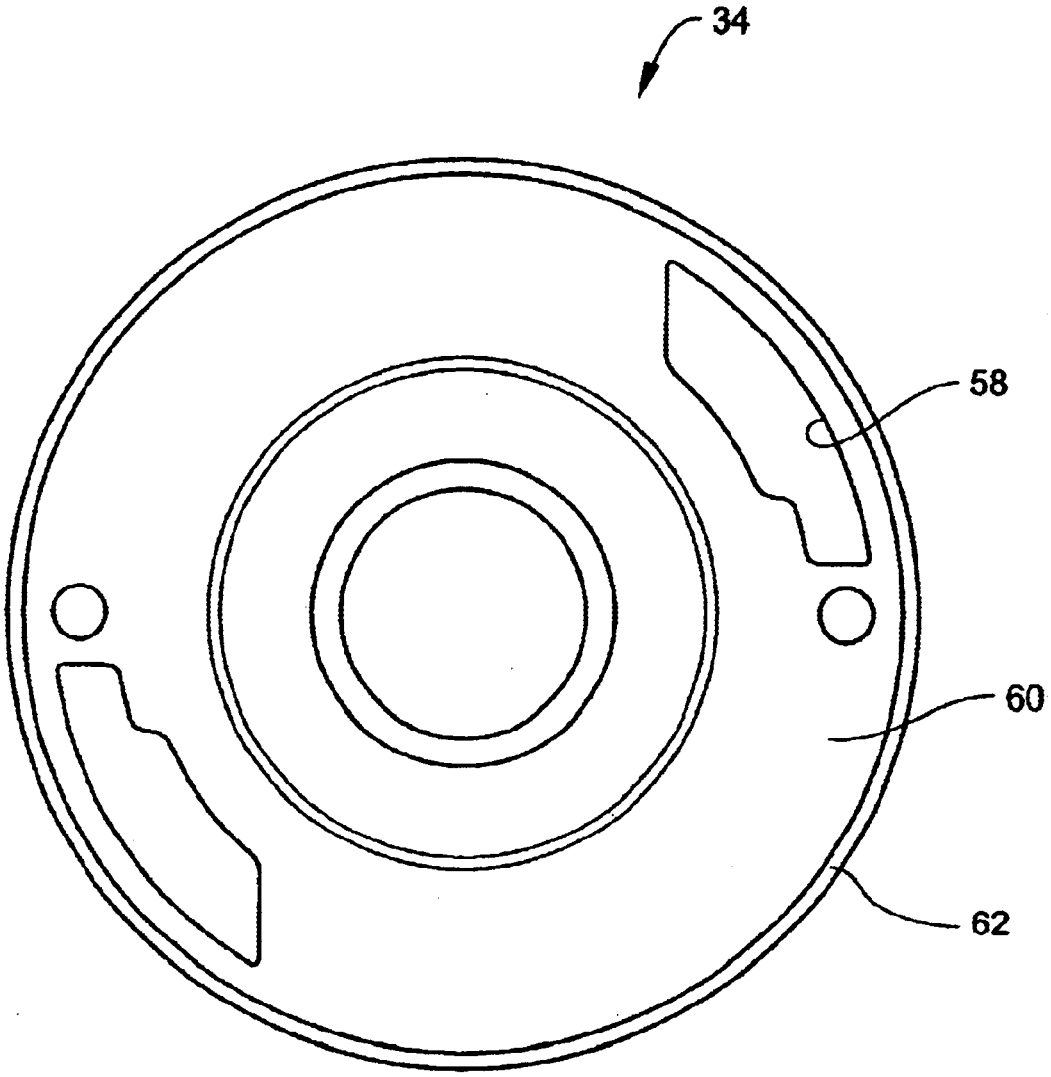
FIG. 8 is a view taken along lines 8—8 of FIG. 7.
Figure 9:
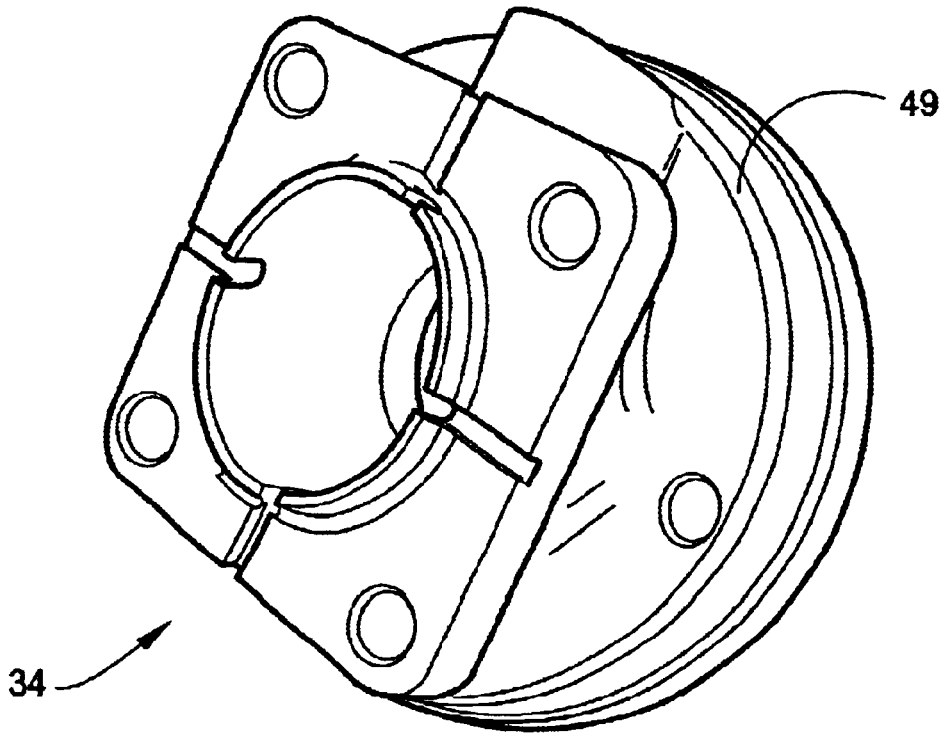
FIG. 9 is a perspective view of the drive cover of FIG. 3.
Figure 13:
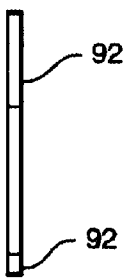
FIG. 13 is a side view of the seal of FIG. 10.
Figure 12:
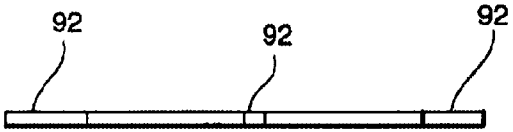
FIG. 12 is top view of the seal of FIG. 10.
Figure 10:
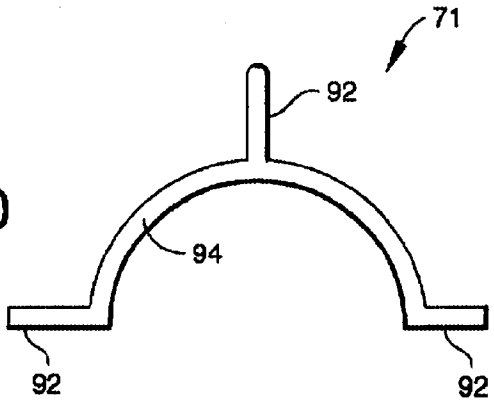
FIG. 10 is a front view of a drive seal constructed in accordance with the present invention.
Figure 11:
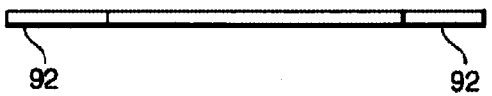
FIG. 11 is a bottom view of the seal of FIG. 10.

FIGS. 6, 7, 8 and 9 illustrate the drive cover 34 of the pump 30. The drive cover 34 is unitary component comprising a body portion 48, an imperforate neck 50, and a flange 38. The drive cover 34 may be formed from a variety of materials, for example an aluminum alloy, and may be manufactured using any known method, such as casting, forging, or machining from a solid blank. The body portion 48 may incorporate a chamfer or broken edge 49 (see FIG. 9) which eases assembly and installation of the pump 30 by increasing the working space around the neck area of the drive cover 34. The interior of the drive cover 34 is hollow. A central bore 52 which accommodates a portion of the pump shaft and a shaft coupler (not shown) passes along the longitudinal axis "A" of the drive cover 34. An intake port 54 connects with an internal plenum 56, which in turn connects with interior ports 58 (see FIG. 8). As shown in FIG. 8, the body portion 48 has a circular flat sealing surface 60 which mates against a corresponding sealing surface 42 of the stator 32. A rim 62 is disposed around the periphery of the sealing surface 60 and forms part of a sealed joint, which is described in more detail below. In contrast to the prior art, this rim 62 is integral with the drive cover 34 and accordingly no separate band is required for the drive-cover-to-stator joint.

The neck 50 which connects the flange 38 and the body portion is imperforate. As used herein, the term "imperforate" is used to mean that no holes or openings are formed in the lateral surfaces of the neck 50. This may be contrasted with the prior art described above in which drain openings are formed in the neck of the drive cover. The absence of openings in the neck 50 prevents any fluids from entering the body portion 48 or the central bore 52 when fluids are directed at the neck 50. This might occur, for example, when the exterior of the pump 30 is washed with a spray of fluid, such as that denoted "S" in FIG. 3.

The flange 38 is a shape which is designed to mate with an accessory pad of an engine (not shown). The bore 52 passes through the flange 38 and the flange 38 includes a plurality of bolt holes 64 which receive fasteners used to secure the pump 30 to the accessory pad. The mounting face 66 of the flange 38 is generally planar and is finely machined to provide a good sealing surface. a circular upstanding rim 68 protrudes axially from the face 66. The rim 68 provides support for a gasket and locates the pump 30 during mounting. A plurality of drain grooves 70, which receive a drain seal, are formed in the face 66. In the particular example shown, the groove pattern comprises a plurality of radially extending grooves 72 connected by a circumferentially-extending groove 74. The circumferentially-extending groove 74 illustrated in the present example is circular; however, no particular shape is required so long as the circumferentially-extending groove 74 interconnects the radially extending grooves 72. The radially extending grooves 72 pass through the rim 68 and form a continuous path from the peripheral edge 76 of the flange 38 to the bore 52. In the illustrated example, a portion of the rim 68 adjacent one of the radial grooves 72 is machined away to define an enlarged pocket 78, the function of which is described in more detail below.

Figure 17:
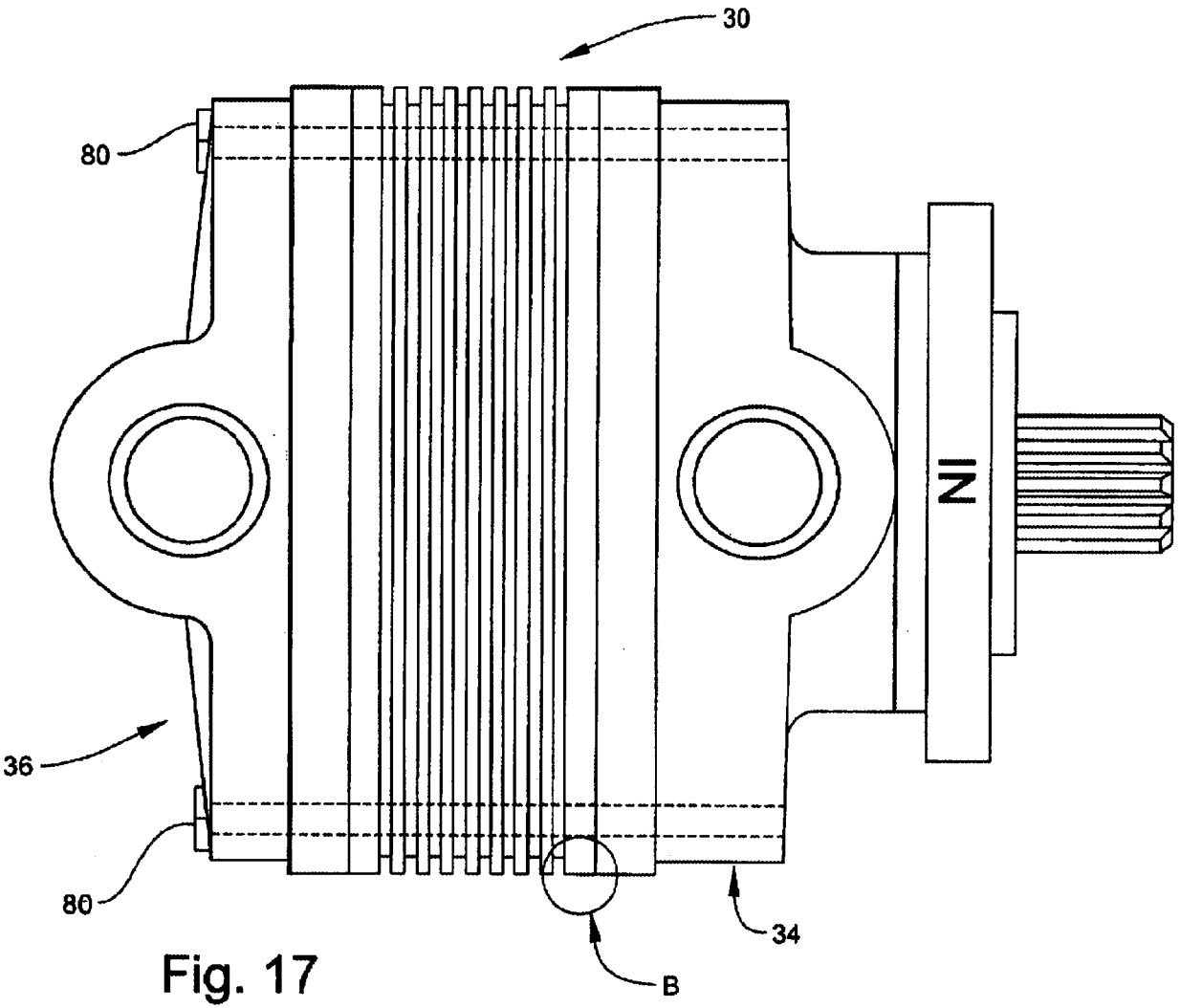
FIG. 17 is a top view of a pump showing a clamping arrangement in accordance with the present invention.

FIG. 17 illustrates the assembly of the pump 30. As discussed above, the rear cover 36, stator 32, and drive cover 34 are clamped togther with fasteners such as through bolts 80. In prior art applications, a pair of oppositely-facing bolts (not shown) are inserted from each cover and are threaded into holes in the stator 32. However, in the present invention, through bolts 80 are inserted in the rear cover 36, pass through holes in the stator 32, and are received in threads in the drive cover 34. The use of through bolts 80 in this manner provides the maximum possible effective bolt length, which may be on the order of about four times greater effective bolt length than the prior art arrangement. Because the bolts stretch a fixed amount per unit length for a given preload, the use of through bolts 80 will provide a greater total stretch and will maintain the desired clamp load better than shorter bolts, thus reducing the possibility of the bolts loosening during operation. The through bolts 80 may also be installed in the opposite direction, that is, they may be inserted through the drive cover 34 and received in threads in the rear cover 36. Other known types of fasteners, such as bolts and nuts, or rivets, may also be substituted for the through bolts 80.

Figure 14:
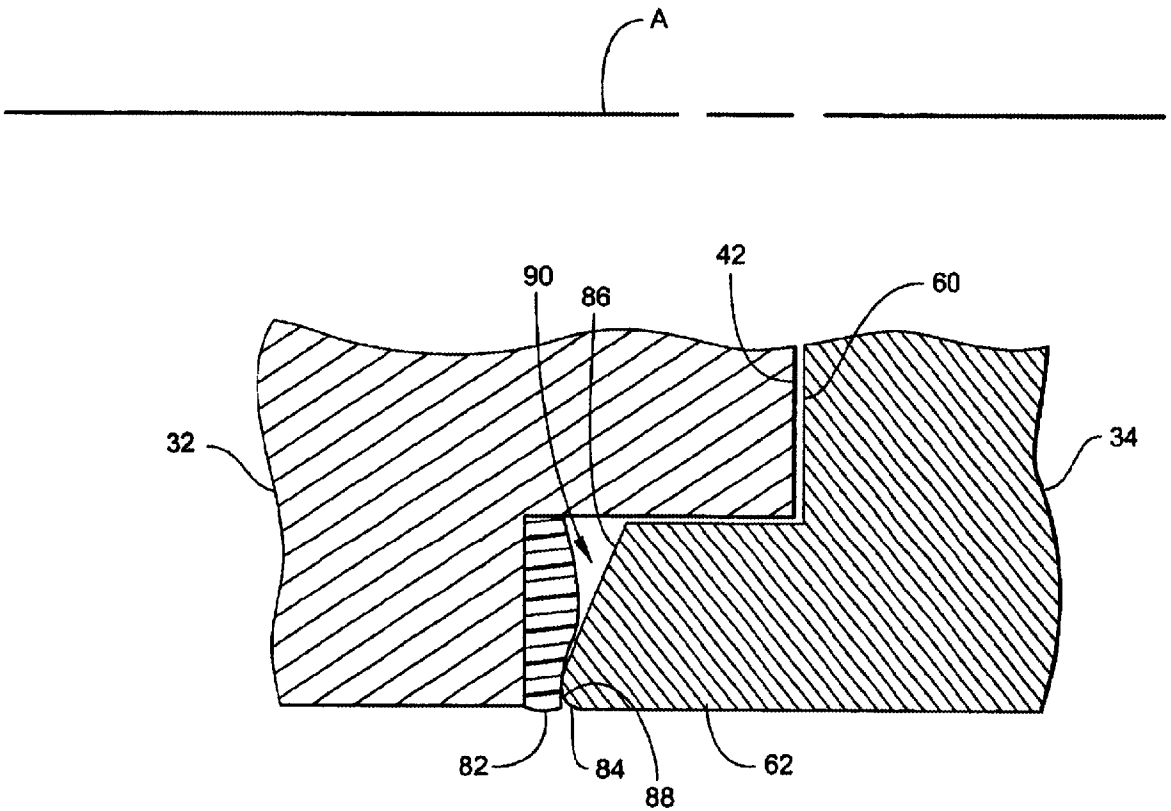
FIG. 14 is a partial cross-sectional view showing the details of the sealing arrangement of the stator and the drive cover.

FIG. 14 illustrates the mating portions of outer edges of the drive cover 34 and stator 32, respectively (see detail "B" of FIG. 17). The sealing surfaces 42 and 60 are finely machined and are intended to create a metal-to-metal seal. However, the axial lengths of the rims of the components are subject to manufacturing variation. Therefore, an annular seal 82 of a resilient material, such as synthetic rubber, is used to fill the gap between the rims. This seal 82 must be firmly squeezed in order to create an acceptable sealed joint. However, the resilient material is essentially incompressible, and if the volume of the seal 82 exceeds the volume of the space available, the sealing surfaces 42 and 60 will be held apart and will not seal. Therefore, the rim 62 of the drive cover 34 is formed in a profile which allows an expansion volume for the seal 82. In the illustrated example, the rim 62 has a radiused outer edge 84 which meets an angled surface 86 at a tangent, creating a beveled shape to the rim 62. The two surfaces 84 and 86 combine to define a contact point 88 and an expansion volume 90. When the drive cover and the stator 32 are clamped together, the contact point 88 of the profile provides a very small annular contact area so that the seal 82 will be consistently squeezed in the axial direction. The expansion volume 90 then allows the seal 82 to bulge out as shown so that the sealing surfaces 42 and 60 can meet in metal-to-metal contact. Although not shown, it is noted that the rear cover 36 may include a sealing surface and an integral rim which accepts a seal and mates to the stator 32 in the same manner as the drive cover 34 described above. Furthermore, the arrangement described above may be reversed if desired. That is, the stator 32 could include the protruding rim with the beveled edge, while the drive cover 34 would have a complementary notch.

FIGS. 10–13 illustrate the drain seal 71 in more detail. The drain seal 71 is a generally flat member of an appropriate resilient sealing material such as synthetic rubber. The drain seal 71 illustrated comprises three radially extending arms 92 connected to an arcuate central portion 94. The thickness of the drain seal 71 may be selected to be slightly greater than the depth of the grooves 70, to ensure compression of the drain seal and proper sealing.

Figure 16:
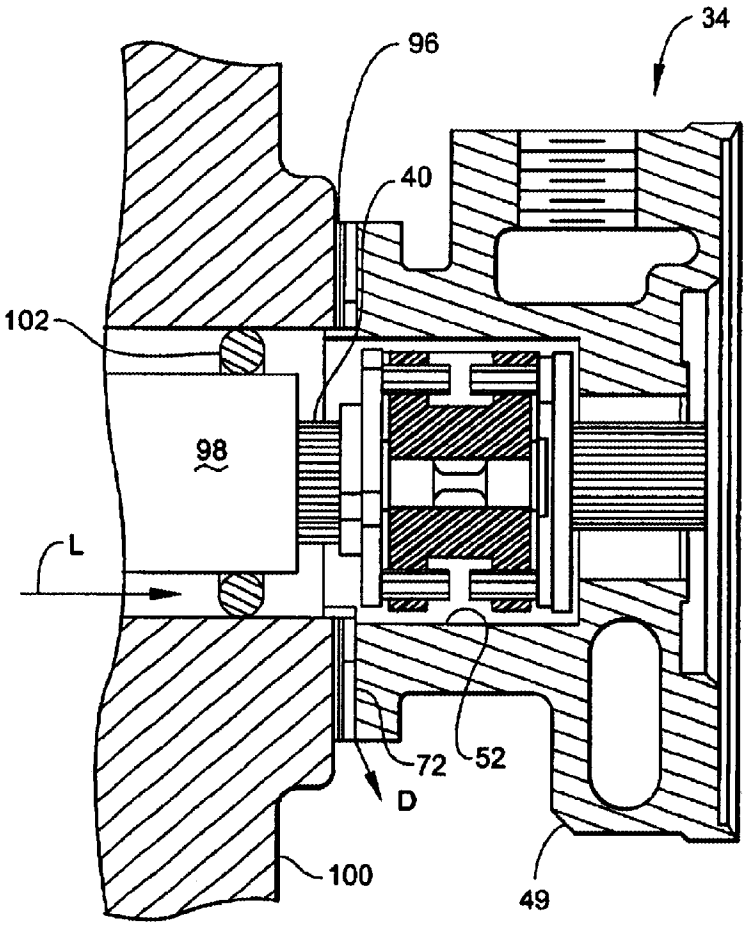
FIG. 16 is a cross-sectional view of the drive cover mounted to an engine accessory pad.
Figure 15:
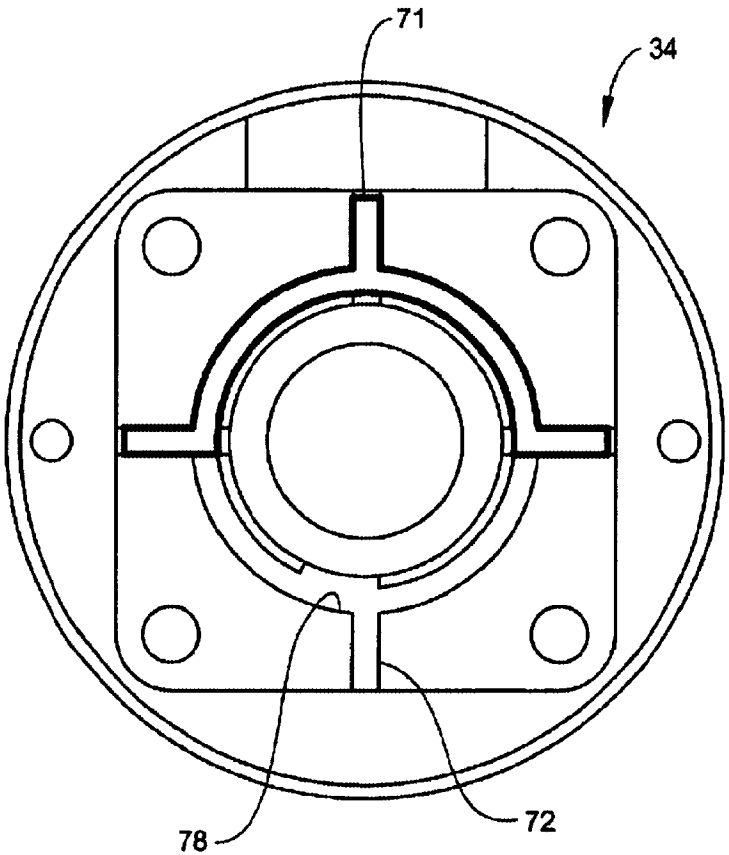
FIG. 15 is an end view of the sealing face of the drive cover with a drain seal installed therein.

Referring now to FIGS. 15 and 16, the air pump 30 is mounted as follows. An orientation is selected. This orientation is usually determined by the configuration of the particular engine to which the air pump 30 is to be mounted. The selection of orientation thus results in one of the drain grooves 72 pointing vertically downward or nearly so. This groove is denoted the "bottom" groove for reference purposes. The drain seal 71 is placed into the grooves 70 so that the bottom groove is open and the remaining grooves are blocked, as shown in FIG. 15. The drain seal 71 protrudes slightly from the mounting face 66 of the flange 38. A planar gasket 96 is then placed on the face 66 of the flange 38. The air pump 30 is then installed so that the shaft 40 engages the accessory shaft 98 and the pump 30 is in the selected orientation. The presence of the pocket 78 allows oil to drain to the bottom groove even if the bottom groove does not face exactly downward. The pump is then secured to the accessory pad 100 with fasteners such as studs and nuts passing through the holes in the flange 38 and into the accessory pad 100 (fasteners not shown for clarity). As the fasteners are tightened, the drain seal 71 is compressed, causing it to completely fill the grooves 70. Any excess volume of the drain seal 71 may expand radially outward into the grooves 70.

In operation, some oil will tend to leak past the accessory shaft seal 102 and pass towards the air pump 30, as indicated by the arrow labeled "L" in FIG. 16. This leakage flow, upon reaching the face 66 of the flange 38, immediately flows into the bottom groove and then drains overboard, as shown by the arrow labeled "D". Unlike the prior art drain arrangement, oil does not accumulate in the bore 52. This greatly reduces the chance of oil passing into the working parts of the pump 30. Furthermore, because the oil is not flung out of the pump 30, it is simple to trace the source of an oil leak to the shaft seal 102.

Although an exemplary embodiment the present invention has been described in which a plurality of drain channels are formed in the face of a mounting flange, it is also possible to implement the invention in other ways. The primary principle of the invention is to drain the oil away as close to the engine and as far away from the interior of the pump 30 as possible. For example, if desired, a plurality of radial channels may be drilled in the peripheral edge 76 of the flange 38 which are in fluid communication with the inner bore. When the pump 30 is installed, the channel which will be facing vertically downwards would be left open, while plugs would be installed in the other channels.

The foregoing has described an air pump having a drive cover with an imperforate neck. A mounting flange contains a plurality of drain grooves. A drain seal is received in a portion of the drain grooves and is used to seal the drain channels which are not selected for use. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation—the invention being defined by the appended claims.

What is claimed is:

1. A dry air pump for being attached to an oil-lubricated engine, comprising:

a housing containing a plurality of movable engine-driven vanes for pumping a fluid;

a longitudinally-extending neck having imperforate lateral surfaces defining a central bore, wherein a first end of said neck is attached to said housing; and a flange disposed at an opposite end of said neck from said first end, said flange having a mounting face, wherein a plurality of generally radially extending drain passages are formed through said flange, said drain passages communicating with said central bore to form a fluid flow path between said bore and the exterior of said flange.

2. The dry air pump of claim 1, further comprising means for blocking selected ones of said drain passages.

3. The dry air pump of claim 1, wherein said drain passages comprise a plurality of radial channels passing through the peripheral edge of said flange.

4. The dry air pump of claim 1, wherein said drain passages comprise a plurality of radially-extending grooves formed in said mounting face.

5. The dry air pump of claim 4, wherein said radially-extending grooves are connected by a circumferentially-extending groove formed in said mounting face, said circumferentially-extending groove intersecting each of said radially-extending grooves.

6. The dry air pump of claim 5, wherein said circumferentially-extending groove further includes at least one enlarged circumferentially-extending pocket disposed at the intersection of said circumferentially-extending groove and one of said radially-extending grooves.

7. The dry air pump of claim 4, further comprising a circular rim extending axially away from said mounting face, wherein said radially-extending grooves pass through said rim.

8. The dry air pump of claim 5, further comprising a resilient seal for being received in said grooves, said seal comprising a plurality of radially-extending legs connected by a an arcuate center portion, said seal blocking selected ones of said radially-extending grooves.

9. The dry air pump of claim 1, wherein said neck and said flange are attached to a body portion, and said body portion, said neck and said flange collectively form a drive cover.

10. The dry air pump of claim 9, wherein said body portion has an chamfered edge.

11. The dry air pump of claim 9, wherein said accessory comprises an assembly of said drive cover and a rear cover disposed on opposite ends of an elongated stator.

12. The dry air pump of claim 11, wherein said drive cover, said stator, and said rear cover are clamped together by at least one fastener which passes through one of said rear cover and said drive cover, and passes through said stator, and is secured into the other of said drive cover and said rear cover.

13. The dry air pump of claim 11, wherein:

one of said stator and said body of said drive cover has a notch formed in the outer periphery of an end thereof for receiving a circumferentially-extending resilient seal, said notch further defining an axially facing raised sealing surface;

the other of said stator and said body of said drive cover includes a flat sealing surface for being disposed in contact with said raised sealing surface, and a rim disposed around the periphery of, and extending axially away from, said flat sealing surface, wherein an axially-facing surface of said rim is beveled to form a narrow contact surface; and wherein, when said stator and said drive cover are assembled, said rim surrounds said raised sealing surface, and a portion of said resilient seal is compressed in the axial direction between said narrow contact surface and an axially-facing portion of said notch, while another portion of said seal protrudes into an expansion volume defined between said notch and said beveled surface.

14. A dry air pump for being attached to an oil-lubricated engine, comprising:

a stator housing a plurality of movable engine-driven vanes for pumping a fluid;

a cover for being attached to an end of said stator;

one of said stator and a body portion of said drive cover having a notch formed in the outer periphery of an end thereof for receiving a circumferentially-extending resilient seal, said notch further defining an axially facing raised sealing surface;

the other of said stator and said cover including a flat sealing surface for being disposed in contact with said raised sealing surface, and a rim disposed around the periphery of and extending axially away from said flat sealing surface wherein an axially-facing surface of said rim is beveled to form a narrow contact surface;

wherein, when said stator and said cover are assembled, said rim surrounds said raised sealing surface, and a portion of said resilient seal is compressed in the axial direction between said narrow contact surface and an axially-facing portion of said notch, while another portion of said seal protrudes into an expansion volume defined between said notch and said beveled surface.

15. The dry air pump of claim 14 wherein said cover is a drive cover including:

a longitudinally-extending neck having imperforate lateral surfaces defining a central bore; and a flange disposed at an end of said neck, said flange having a mounting face, wherein a plurality of generally radially extending drain passages are formed through said flange, said drain passages communicating with said central bore to form a fluid flow path between said bore and the exterior of said drive cover.

16. The dry air pump of claim 15 further comprising means for blocking selected ones of said drain passages.

17. The dry air pump of claim 15 wherein said drain passages comprise a plurality of radial channels passing through the peripheral edge of said flange.

18. The dry air pump of claim 15 wherein said drain passages comprise a plurality of radially-extending grooves formed in said mounting face.

19. The dry air pump of claim 18 wherein said radially-extending grooves are connected by a circumferentially-extending groove formed in said mounting face, said circumferentially-extending groove intersecting each of said radially-extending grooves.

20. The dry air pump of claim 19 wherein said circumferentially-extending groove further includes at least one enlarged circumferentially-extending pocket disposed at the intersection of said circumferentially-extending groove and one of said radially-extending channels.

21. The dry air pump of claim 18 further comprising a circular rim extending axially away from said mounting face, wherein said radially-extending grooves pass through said rim.

22. The dry air pump of claim 19 further comprising a resilient seal for being received in said grooves, said seal comprising a plurality of radially-extending legs connected by a an arcuate center portion, said seal blocking selected ones of said radially-extending grooves.

23. The dry air pump of claim 15 wherein said accessory comprises an assembly of said drive cover and a rear cover disposed on opposite ends of said stator.

24. The dry air pump of claim 23, wherein said drive cover, said stator, and said rear cover are clamped together by at least one fastener which passes through one of said rear cover and said drive cover, and passes through said stator, and is secured in the other of said drive cover and said rear cover.

* * * * *

UNITED STATES PATENT AND TRADEMARK OFFICE

CERTIFICATE OF CORRECTION

PATENT NO. : 6,945,759 B2
APPLICATION NO. : 10/439945
DATED : September 20, 2005
INVENTOR(S) : Timothy H. Henderson It is certified that error appears in the above-identified patent and that said Letters Patent is hereby corrected as shown below:

Column 8, line 56, delete “a”.

Column 8, line 62, delete “an” and enter --a--.

Column 8, line 63, delete “accessory” and enter --housing--.

Column 10, line 38, delete “a”.

Column 10, line 40, delete “said accessory comprises an assembly of”, Column 10, line 41, enter --are-- before “disposed”.

Signed and Sealed this

Ninth Day of January, 2007

JON W. DUDAS
*Director of the United States Patent and Trademark Office*